US006315679B1

(12) United States Patent
Sano

(10) Patent No.: US 6,315,679 B1
(45) Date of Patent: Nov. 13, 2001

(54) THREAD WOUND GOLF BALL

(75) Inventor: Yoshinori Sano, Akashi (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/358,844

(22) Filed: Jul. 22, 1999

(30) Foreign Application Priority Data

Jul. 27, 1998 (JP) ..... 10-210837

(51) Int. Cl.[7] ..... A63B 37/06
(52) U.S. Cl. ..... 473/357; 524/432
(58) Field of Search ..... 473/356, 357, 473/359, 373, 374

(56) References Cited

U.S. PATENT DOCUMENTS

| | | | | |
|---|---|---|---|---|
| 4,683,257 | * | 7/1987 | Kakiuchi et al. | 524/908 |
| 4,955,613 | * | 9/1990 | Gendreau et al. | 524/908 |
| 5,445,387 | * | 8/1995 | Maruko et al. | 473/356 |
| 5,766,096 | * | 6/1998 | Maruko et al. | 473/373 |
| 5,792,009 | * | 8/1998 | Maruko | 473/373 |
| 5,948,859 | * | 9/1999 | Sano et al. | 473/359 |

FOREIGN PATENT DOCUMENTS

B22678240 8/1997 (JP) .

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

The present invention provides a thread wound golf ball having excellent rebound characteristics. The present invention relates to a thread wound golf ball comprising a solid center, a thread rubber layer formed on the solid center, and at least one layer of a cover covering the thread rubber layer, wherein the solid center comprises at least one rubber layer, the rubber layer is formed from a rubber composition comprising a polybutadiene mixture, a metal salt of an unsaturated carboxylic acid, an organic peroxide and an inorganic filler, and the polybutadiene mixture includes (a) a polybutadiene containing a cis-l,4 bond of not less than 80% and having a Mooney viscosity of 50 to 100 $ML_{1+4}$ (100° C.), synthesized using nickel-containing catalyst, and (b) a polybutadiene containing a cis-1,4 bond of not less than 40% and having a Mooney viscosity of 20 to 90 $ML_{1+4}$(100° C.), synthesized using lanthanide-containing catalyst, a weight ratio (a)/(b) being 30/70 to 90/10.

5 Claims, No Drawings

THREAD WOUND GOLF BALL

FIELD OF THE INVENTION

The present invention relates to a thread wound golf ball. More particularly, it relates to a thread wound golf ball having excellent rebound characteristics.

BACKGROUND OF THE INVENTION

Hitherto, a polybutadiene containing a cis-1, 4 bond of not less than 80%, which is synthesized using nickel-containing catalyst, has been mainly used as a base rubber of a rubber composition for a one-piece solid golf ball, a core of a solid golf ball (such as a two-piece golf ball or three-piece golf ball), or a solid center of a thread wound golf ball. This is because the nickel-catalyzed polybutadiene imparts excellent rebound characteristics and good durability to the golf balls.

It is also known to the art that a lanthanide-catalyzed polybutadiene, i.e. a polybutadiene synthesized using lanthanoid-containing catalyst, is used for the application of golf balls. For example, Japanese Patent No. 2678240 proposes that a rubber mixture of 85 to 15 parts by weight of a nickel- or cobalt-catalyzed polybutadiene having a cis-1, 4 content of more than 40% and a Mooney viscosity of less than 50, and 15 to 85 parts by weight of a lanthanide-catalyzed polybutadiene having a cis-1, 4 content of more than 40% and a Mooney viscosity of less than 50 can be suitably used for a golf ball. However, when the nickel- or cobalt-catalyzed polybutadiene having such a low Mooney viscosity (less than 50) and the lanthanide-catalyzed polybutadiene having such a low Mooney viscosity (less than 50) are used as base rubber for a rubber composition of golf balls, the resulting golf ball does not have sufficient rebound characteristics and durability.

A thread wound golf ball is composed of a solid center, a thread rubber layer formed on the solid center and a cover formed on the thread rubber layer, and the thread rubber layer is believed to give rebound characteristics to the golf ball. In order to obtain high launch angle and low spin amount for extending flight distance, it has recently been proposed that the thread rubber layer is made thinner and the solid center is made larger. The thin thread rubber layer does not give sufficient rebound characteristics and therefore the solid center has to have higher rebound characteristics.

OBJECTS OF THE INVENTION

A main object of the present invention is to provide a thread wound golf ball having excellent rebound characteristics.

According to the present invention, the object described above has been accomplished by using a rubber composition comprising a mixture consisting of (a) polybutadiene synthesized using nickel-containing catalyst and (b) polybutadiene synthesized using lanthanide-containing catalyst for a solid center, adjusting a Mooney viscosity and a weight ratio of the polybutadienes (a) and (b) to a specified range, thereby providing a thread wound golf ball having excellent rebound characteristics.

SUMMARY OF THE INVENTION

The present invention provides a thread wound golf ball comprising a solid center, a thread rubber layer formed on the solid center, and at least one layer of a cover covering the thread rubber layer, wherein the solid center comprises at least one rubber layer, the rubber layer is formed from a rubber composition comprising a polybutadiene mixture, a metal salt of an unsaturated carboxylic acid, an organic peroxide and an inorganic filler, and the polybutadiene mixture consists of (a) a polybutadiene containing a cis-1,4 bond of not less than 80% and having a Mooney viscosity of 50 to 100 $ML_{1+4}$(100° C.), synthesized using nickel-containing catalyst, and (b) a polybutadiene containing a cis-1,4 bond of not less than 40% and having a Mooney viscosity of 20 to 90 $ML_{1+4}$(100° C.), synthesized using lanthaide-containing catalyst, a weight ratio (a)/(b) being 30/70 to 90/10.

DETAILED DESCRIPTION OF THE INVENTION

The thread wound golf ball of the present invention comprises a solid center obtained by press-molding and vulcanizing the rubber composition, a thread rubber layer formed on the solid center, and a cover formed on the thread rubber layer. The solid center is formed from a rubber composition comprising a polybutadiene mixture, a metal salt of an unsaturated carboxylic acid, an organic peroxide, an inorganic filler, optionally antioxidant and the like. The solid center used in the present invention may have single layer structure or multi-layer structure that has two or more layers.

The mixture of polybutadienes used in the rubber composition for the solid center of the present invention consists of (a) a polybutadiene containing a cis-1,4 bond of not less than 80% and having a Mooney viscosity of 50 to 100 $ML_{1+4}$(100° C.), synthesized using nickel-containing catalyst, and (b) a polybutadiene containing a cis-1,4 bond of not less than 40% and having a Mooney viscosity of 20 to 90 $ML_{1+4}$(100° C.), synthesized using lanthanide-containing catalyst.

Nickel-containing catalysts used for synthesizing the polybutadiene (a) in the present invention are, for example, one-component catalysts such as nickel on diatomaceous earth as a carrier, two-component catalysts such as Raney nickel/titanium tetrachloride, and three-component catalysts such as nickel compound/organometal/trifluoroborate etherate. Examples of the nickel compounds include reduced nickel on carrier, Raney nickel, nickel oxide, nickel carboxylate, organic nickel complex salts and the like. Examples of the organometals include trialkyl aluminums such as triethyl aluminum, tri-n-propyl aluminum, triisobutyl aluminum, and tri-n-hexyl aluminum; alkyl lithiums such as n-butyl lithium, s-butyl lithium, t-butyl lithium and 1,4-butane dilithium; dialkyl zincs such as diethyl zinc, dibutyl zinc; and the like.

Polymerization of butadiene in the presence of these catalysts is generally carried out by continuously charging butadiene monomer into a reactor along with a conventional solvent and the catalyst such as nickel octanoate and triethyl aluminum, and controlling the reaction temperature in the range of 5 to 60° C. and the reaction pressure in the range of 1 to about 70 atmospheres, such that a product having a desired Mooney viscosity may be obtained.

The resulting polybutadiene (a) contains a cis-1,4 bond of not less than 80%, and has a Mooney viscosity of 50 to 100 $ML_{1+4}$(100° C.), preferably 50 to 85 $ML_{1+4}$(100° C.), more preferably 55 to 75 $ML_{1+4}$(100° C.). When the Mooney viscosity of the polybutadiene (a) is lower than 50 $ML_{1+4}$ (100° C.), the workability when mixing the rubber composition is good, but the rebound characteristics of the resulting golf ball are degraded. On the other hand, when the Mooney viscosity is higher than 100 $ML_{1+4}$(100° C.), the rebound characteristics of the resulting golf ball are good, but the workability when mixing is degraded, which reduces productivity.

In the present invention, it is desired that the polybutadiene (a) has a ratio (Mw/Mn) of weight average molecular weight (Mw) to number average molecular weight (Mn) of 4.0 to 8.0, preferably 4.0 to 7.0, more preferably 4.0 to 6.0. The ratio (Mw/Mn) is generally an index of molecular weight distribution. When the ratio (Mw/Mn) of the polybutadiene (a) is smaller than 4.0, the workability is degraded. On the other hand, when the ratio (Mw/Mn) is larger than 8.0, the workability is good, but the rebound characteristics of the resulting golf ball are degraded.

Examples of the polybutadiene (a) will be shown by a trade name thereof. Examples of the polybutadiene (a) include BR-18, which is commercially available from JSR Co., Ltd., and the like.

The term "Mooney viscosity" as used herein refers to an indication of a viscosity which is measured using a Mooney viscometer as a kind of rotational plastometer. The Mooney viscosity is typically used for measuring a viscosity of a rubber composition in the field of rubber industry. The Mooney viscosity is determined by closely putting a rubber composition in a gap between a cylindrical dice and a rotor positioned at the center of the dice, and then measuring a torque occurring when rotating the rotor at a testing temperature of 100° C., for a preheating time of 1 minute, at a number of revolutions of 2 rpm, for a time of revolution of 4 minutes. The Mooney viscosity is expressed in $ML_{1+4}$ (100° C.), wherein M represents a Mooney viscosity, L represents a large rotor (L type) as a shape of the rotor, (1+4) represents that a preheating time is 1 minute and a time of revolution of the rotor is 4 minutes, and 100° C. represents a testing temperature. The measurement is generally conducted according to JIS K 6300.

Lanthanide-containing catalysts used to synthesize the polybutadiene (b) in the present invention are, for example, a lanthaide compound, an organoaluminum compound, a Lewis base and optionally a Lewis acid. Examples of the lanthanide compounds include halides, carboxylates, alcoholates, thioalcoholates and amides of rare earth metals having atomic numbers of 57 to 71, with neodymium being the preferred rare earth metal. Examples of the organoaluminum compounds include those having the general formula:

$$Al\ R_1R_2R_3$$

wherein $R_1$, $R_2$ and $R_3$, which may be the same or different, are independently selected from hydrogen or hydrocarbon group having 1 to 8 carbon atoms. The Lewis bases serve to convert the lanthanide compounds into complexes. Acetylacetone, ketone, alcohols and the like may be used for this purpose. Examples of the Lewis acids include aluminum halides of the general formula:

$$Al\ X_nR_{3-n}$$

wherein X is a halogen, R is alkyl, aryl or aralkyl group having 1 to 20 carbon atoms, and n is 1, 1.5, 2 or 3; or silicon tetrachloride, tin tetrachloride, titanium tetrachloride, and the like.

When butadiene is polymerized in the present of the lanthanide-containing catalyst, the molar ratio of butadiene to lanthanide compound is within the range of $5\times10^2$ to $5\times10^6$, preferably $1.0\times10^3$ to $1.0\times10^5$. The molar ratio of organoaluminum compound to lanthanide compound is within the range of 5 to 500, preferably 10 to 300. The molar ratio of Lewis base to lanthanide compound is within the range of at least 0.5, preferably 1 to 20. When Lewis acid is used, the molar ratio of halide in the Lewis acid to lanthanide compound is within the range of 1 to 10, preferably 1.5 to 5. In the polymerization of butadiene, the lanthanide-containing catalysts may be used in the form of solution in an organic solvent such as n-hexane, cyclohexane, n-heptane, toluene, xylene, benzene and the like, or carried on suitable carriers such as silica, magnesia and magnesium chloride. The polymerization of butadiene may be carried out in a solvent, or bulk polymerization without a solvent may also be employed. The polymerization temperature is in the range of −30 to 150° C., and the polymerization pressure may vary depending on other conditions.

The resulting polybutadiene (b) contains a cis-1,4 bond of not less than 40%, and has a Mooney viscosity of 20 to 90 $ML_{1+4}$(100° C.), preferably 25 to 80 $ML_{1+4}$(100° C.), more preferably 30 to 70 $ML_{1+4}$(100° C.). When the Mooney viscosity of the polybutadiene (b) is lower than 20 $ML_{1+4}$ (100° C.), the workability is good, but the rebound characteristics of the resulting golf ball are degraded. On the other hand, when the Mooney viscosity is higher than 90 $ML_{1+4}$ (100° C.), the rebound characteristics of the resulting golf ball are good, but the workability is degraded, which reduces productivity.

Examples of the polybutadiene (b) will be shown by a trade name thereof. Examples of the polybutadiene (b) include Europrene Neocis BR 60, which is commercially available from Enichem Co., Ltd., and the like.

In the mixture of polybutadienes of the present invention, a weight ratio (a)/(b) of polybutadiene (a) to polybutadiene (b) is within the range of 30/70 to 90/10, preferably 40/60 to 75/25, more preferably 45/55 to 65/35. When the amount of polybutadiene (a) is smaller than 30% by weight and the amount of polybutadiene (b) is larger than 70% by weight, based on the total weight of the mixture of polybutadienes, the rebound characteristics of the resulting golf ball are degraded. On the other hand, when the amount of polybutadiene (b) is smaller than 10% by weight and the amount of polybutadiene (a) is larger than 90% by weight, based on the total weight of the mixture of polybutadienes, the workability is degraded.

In the present invention, the metal salt of unsaturated carboxylic acid is used as a co-crosslinking agent. The unsaturated carboxylic acid includes unsaturated carboxylic acids having 3 to 8 carbon atoms, such as acrylic acid, methacrylic acid, cinnamic acid, crotonic acid, itaconic acid, fumaric acid, and the like. Preferred are acrylic acid and methacrylic acid. The metal salts include sodium, potassium, lithium, magnesium, calcium, zinc, barium, aluminum, tin, zirconium, cadmium salts, and the like. Preferred are a sodium salt, zinc salt and magnesium salt. The amount of the metal salt of the unsaturated carboxylic acid is from 10 to 60 parts by weight, preferably from 15 to 45 parts by weight, based on 100 parts by weight of the mixture of polybutadienes. When the amount of the metal salt of the unsaturated carboxylic acid is larger than 60 parts by weight, the solid center is too hard, and the shot feel of the resulting golf ball is poor. On the other hand, when the amount of the metal salt of the unsaturated carboxylic acid is smaller than 10 parts by weight, the solid center is too soft.

Therefore the rebound characteristics of the resulting golf ball are degraded, which reduces flight distance.

The organic peroxide, which acts as crosslinking agent or curing agent, includes for example dicumyl peroxide, di-t-butyl peroxide, 1,1-di-t-butylperoxy-3,3,5-trimethylcyclohexane, 2,5-dimethyl-2,5-di(t-butylperoxy)-hexane, and the like. The preferred organic peroxide is dicumyl peroxide. The amount of the organic peroxide is not limited, but is preferably from 0.1 to 10 parts by weight, preferably from 0.5 to 5.0 parts by weight, based on 100 parts by weight of the mixture of polybutadienes. When the amount of the organic peroxide is smaller than 0.1 parts by weight, the solid center is too soft. Therefore the rebound characteristics of the resulting golf ball are degraded, which reduces flight distance. On the other hand, when the amount of the organic peroxide is larger than 10 parts by weight, the solid center is too hard, and the shot feel of the resulting golf ball is poor.

The inorganic filler includes, for example, zinc oxide, barium sulfate, calcium carbonate, silica and the like. The amount of the inorganic filler is from 3 to 70 parts by weight, preferably from 5 to 50 parts by weight, based on 100 parts by weight of the mixture of polybutadienes. When the amount of the filler is smaller than 3 parts by weight, the solid center is too light, and the resulting golf ball is too light. On the other hand, when the amount of the filler is larger than 70 parts by weight, the solid center is too heavy, and the resulting golf ball is too heavy.

The rubber composition for the thread wound golf ball of the present invention can contain other components, which have been conventionally used for preparing the core of solid golf balls, such as peptizing agents or antioxidants. If used, an amount of the antioxidant is preferably 0.2 to 1.5 parts by weight, based on 100 parts by weight of the mixture of polybutadienes.

In the thread wound golf ball of the present invention, the solid center has a deformation amount, when applying from an initial load of 10 kgf to a final load of 130 kgf, of 1.5 to 6.0 mm, preferably 2.2 to 5.0 mm, more preferably 2.8 to 4.8 mm. When the deformation amount is smaller than 1.5 mm, the solid center is too hard, and the shot feel of the resulting golf ball is poor. On the other hand, when the deformation amount is larger than 6.0 mm, the solid center is too soft, and the rebound characteristics of the resulting golf ball are degraded.

In the thread wound golf ball of the present invention, it is desired that the solid center has a diameter of 26 to 39 mm, preferably 29 to 38 mm. When the diameter of the solid center is larger than 39 mm, the shot feel is poor. On the other hand, when the diameter of the solid center is smaller than 26 mm, the thickness of the thread rubber layer or cover layer is large, whereby the shot feel of the resulting golf ball is poor, and the rebound characteristics are degraded. The thread rubber layer is then formed on the solid center.

The thread rubber wound on the solid center can be the same one as that which has been conventionally used in the thread rubber layer of the thread wound golf balls. For example, the thread rubber can be one that is obtained by vulcanizing a rubber composition prepared by formulating sulfur, a vulcanization accelerator, a vulcanization aid, an antioxidant and the like to a natural rubber or a blend rubber of the natural rubber and a synthetic polyisoprene. The thread rubber is wound on the solid center by conventional methods, which have used for the thread wound core of the thread wound golf balls. The thread rubber layer may have a thickness of 0.8 to 6.5 mm, preferably 1.0 to 4.5 mm. When the thickness of the thread rubber layer is smaller than 0.8 mm, the thread rubber layer is too thin to exhibit sufficient impact relaxation, and the shot feel is poor. On the other hand, when the thickness is larger than 6.5 mm, the spin amount at the time of hitting increases and the flight distance is reduced.

The cover is then covered on the thread rubber layer. The cover may have single layer structure or multi-layer structure that has two or more layers. In the golf ball of the present invention, the cover may be formed from ionomer resin or the mixture of thereof. Examples of the ionomer resin include a copolymer of ethylene and acrylic acid or methacrylic acid, of which a portion of the acid groups is neutralized with metal ion, or a terpolymer of ethylene, acrylic acid or methacrylic acid and acrylic acid ester, of which a portion of the acid groups is neutralized with metal ion, which has been conventionally used for preparing the cover of solid golf balls. The metal ion which neutralizes a portion of carboxylic acid groups of the copolymer includes an alkali metal ion, such as a sodium ion, a potassium ion, a lithium ion and the like; a divalent metal ion, such as a zinc ion, a calcium ion, a magnesium ion, and the like; and mixture thereof. Preferred are sodium ions, zinc ions, lithium ions and the like, in view of rebound characteristics, durability and the like.

Examples of the ionomer resin will be shown by a trade name thereof. Examples of the ionomer resin, which is commercially available from Mitsui Du Pont Polychemical Co., include Hi-milan 1605 (Na), Hi-milan 1707 (Na), Hi-milan AM7318 (Na), Hi-milan 1706 (Zn), Hi-milan AM7315 (Zn), Hi-milan AM7317 (Zn), Hi-milan AM7311 (Mg) and Hi-Milan MK7320 (K); and Hi-milan 1856 (Na), Hi-milan 1855 (Zn) and Hi-milan AM7316 (Zn) as the terpolymer ionomer resin. Examples of the ionomer resin, which is commercially available from Du Pont U.S.A., include Surlyn 8920 (Na), Surlyn 8940 (Na), Surlyn AD8512 (Na), Surlyn 9910 (Zn), Surlyn AD8511 (Zn), Surlyn 7930 (Li) and Surlyn 7940 (Li); and Surlyn AD8265 (Na) and Surlyn AD8269 (Na) as the terpolymer ionomer resin. Examples of the ionomer resin, which is commercially available from Exxon Chemical Co., include Iotek 7010 (Zn) and Iotek 8000 (Na). Incidentally, Na, Zn, K, Li and Mg, which are described in parentheses after the trade name of the above ionomer resin, indicate their neutralizing metal ion species. These ionomer resins are used alone or in combination thereof. The amount of the ionomer resin is 20% by weight, preferably 40% by weight, based on the total resin component for the cover.

The cover for the golf ball of the present invention can contain various thermoplastic resins, such as styrene resin, polyester resin, polyamide resin, polyurethane resin and the like, in order to improve physical properties of the ionomer resin. The thermoplastic resins are preferably a functional group modified styrene-butadiene-styrene block copolymer or a functional group modified styrene-isoprene-styrene block copolymer. Examples thereof include hydrogenated styrene-isoprene-styrene block copolymers having terminal OH groups, which are commercially available from Kuraray Co., Ltd. under the trade name of "HG-252"; styrene-butadiene-styrene (SBS) block copolymers having polybutadiene block with epoxy groups, which are commercially available from Daicel Chemical Industries, Ltd. under the trade name of "Epofriend AT014", "Epofriend AT015", "Epofriend AT000" and the like; and SBS block copolymers having polybutadiene block with epoxy group, which are then hydrogenated, commercially available from Daicel Chemical Industries, Ltd. under the trade name of "Epofriend AT018", "Epofriend AT019" and the like.

The cover used in the present invention may optionally contain pigments (such as titanium dioxide, etc.), fillers (such as barium sulfate, etc.) and the other additives such as a dispersant, an antioxidant, a UV absorber, a photostabilizer and a fluorescent agent or a fluorescent brightener, etc., in addition to the resin component, as long as the addition of the additive does not deteriorate the desired performance of the golf ball cover. The amount of the pigment is preferably from 0.01 to 10.0 parts by weight based on 100 parts by weight of the cover resin component.

The cover of the present invention may be formed by conventional methods, which have been known in the art and used for forming the cover of the golf balls. For example, there can be used a method which comprises the steps of molding the cover composition into a semi-spherical half-shell, covering the thread wound core with the two half-shells, followed by pressure molding at 130 to 170° C. for 1 to 15 minutes, or a method of injection molding the cover composition directly on the thread wound core to cover it. The cover preferably has a thickness of 0.5 to 3.0 mm. At the time of molding the cover, many depressions called "dimples" may be optionally formed on the surface of the golf ball. Furthermore, paint finishing or marking with a stamp may be optionally provided after the cover is molded for commercial purposes.

EXAMPLES

The following Examples and Comparative Examples further illustrate the present invention in detail but are not to be construed to limit the scope of the present invention.

Examples 1 to 3

Comparative Examples 1 to 3

Production of Solid Center

The rubber compositions for solid centers having formulations shown in Table 2 comprising the polybutadienes shown in Table 1 were mixed by using a mixing roll, and then vulcanized by press-molding at 160° C. for 25 minutes to obtain solid centers having a diameter of 36.0 mm and a weight of 30.0 g. The deformation amount and coefficient of restitution of the resulting solid center were measured, and the results are shown in Table 4. The workability of roll mixing was evaluated, and the results are shown in Table 2. The test methods are described later.

TABLE 1

| Trade name of Polybutadiene | BR-18 | Neocis BR 60 |
|---|---|---|
| Manufacturer | JSR Co., Ltd. | Enichem Co. |
| Type of Catalyst | Nickel | Lanthanide |
| Mooney viscosity [$ML_{1+4}$(100° C.)] *1 | 60 | 63 |
| Content of cis-1,4-bond (%) *2 | 96 | 98 |
| Weight average molecular weight (Mw) *3 | $61 \times 10^4$ | $46 \times 10^4$ |
| Number average molecular weight (Mn) *3 | $12 \times 10^4$ | $13 \times 10^4$ |
| Ratio (Mw/Mn) | 5.1 | 3.5 |

*1: Measurement according to JIS k 6300
*2: NMR (Nuclear magnetic resonance)
*3: GPC (Gel permeation chromatography)

TABLE 2

(parts by weight)

| Center composition | Example No. 1 | Example No. 2 | Example No. 3 | Comparative Example No. 1 | Comparative Example No. 2 | Comparative Example No. 3 |
|---|---|---|---|---|---|---|
| | Polybutadiene | | | | | |
| BR-18 | 80 | 50 | 40 | 100 | — | 20 |
| Neocis BR 60 | 20 | 50 | 60 | — | 100 | 80 |
| Zinc acrylate | 30 | 28 | 25 | 30 | 30 | 30 |
| Zinc oxide | 15 | 14 | 16 | 15 | 15 | 15 |
| Barium sulfate | 20 | 21 | 23 | 20 | 20 | 20 |
| Dicumyl peroxide | 1.0 | 1.2 | 0.9 | 1.0 | 1.0 | 1.0 |
| Antioxidant *4 | 0.5 | 0.5 | 0.5 | 0.5 | 0.5 | 0.5 |
| Workability of roll mixing | ○ | ○ | ○ | x | Δ | Δ |

*4 Antioxidant (trade name "Yoshinox 425") from Yoshitomi Pharmaceutical Industries, Ltd.

Formation of Thread Rubber Layer

Each thread rubber layer was formed on the solid center by winding a thread rubber around the solid center to obtain a thread wound core having a diameter of about 39.0 mm. The thread rubber was prepared from a blend of natural rubber and a low cis-isoprene rubber ("Shell IR-309" commercially available from Shell Chemical Co., Ltd.)=50/50 (weight ratio).

Preparation of Cover Compositions

The formulation materials shown in Table 3 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 200 to 260° C. at the die position of the extruder.

TABLE 3

| Cover composition | Amount (parts by weight) |
|---|---|
| Hi-milan 1605 *5 | 50 |
| Hi-milan 1706 *6 | 50 |
| Titanium dioxide | 2.0 |

*5: Hi-milan 1605 (trade name), ethylene-methacrylic acid copolymer ionomer resin obtained by neutralizing with sodium ion, manufactured by Mitsui Du Pont Polychemical Co., Ltd.
*6: Hi-milan 1706 (trade name), ethylene-methacrylic acid copolymer ionomer resin obtained by neutralizing with zinc ion, manufactured by Mitsui Du Pont Polychemical Co., Ltd.

Production of Golf Ball (Formation of Cover)

The resulting cover compositions were molded into semi-spherical half-shells, encapsuling the resulting thread wound core with the two half-shells, followed by press-molding in the mold for golf ball and then coating with a paint to obtain a thread wound golf ball having an outer diameter of 42.7 mm and a weight of 45.4 g. Compression (Ball compression) and coefficient of restitution of the resulting golf balls were measured, and the results are shown in Table 4. The test methods are as follows.

Test Method (1) Workability of roll mixing

Workability when mixing the rubber composition by a mixing roll is evaluated. The evaluation criteria are as follows.

(Evaluation criteria):

○: Workability is good.

Δ: Workability is fairly poor, because the rubber composition does not wind around the roll once in a while.

X: Workability is poor, because it is difficult to wind the rubber composition around the roll.

(2) Deformation Amount of the Solid Center

The deformation amount was determined by measuring the deformation amount when applying from an initial load of 10 kg to a final load of 130 kg on the solid center.

(3) Coefficient of Restitution

A stainless steel cylinder having a weight of 198.4 g was struck at a speed of 45 cm/sec against a golf ball or a core using a compressed-air actuated resilience gun, and the velocity of the cylinder and the golf ball or the core before and after the strike were measured. The larger the coefficient of restitution is, the more excellent the rebound characteristics are.

(4) Ball Compression

The ball compression of golf balls was determined by the PGA method.

TABLE 4

| | Example No. | | | Comparative Example No. | | |
|---|---|---|---|---|---|---|
| Test item | 1 | 2 | 3 | 1 | 2 | 3 |
| | | (Solid center) | | | | |
| Deformation amount (mm) | 3.45 | 3.85 | 4.20 | 3.45 | 3.45 | 3.45 |
| Coefficient of restitution | 0.794 | 0.795 | 0.794 | 0.789 | 0.786 | 0.789 |
| | | (Golf ball) | | | | |
| Compression | 88 | 84 | 80 | 88 | 88 | 88 |
| Coefficient of restitution | 0.786 | 0.788 | 0.787 | 0.772 | 0.771 | 0.773 |

As is apparent from Table 4, the golf ball of Examples 1 to 3 using for a solid center a rubber composition comprising a mixture consisting of (a) polybutadiene synthesized using nickel-containing catalyst and (b) polybutadiene synthesized using lanthanide-containing catalyst, and adjusting a Mooney viscosity and a weight ratio of the polybutadienes (a) and (b) to a specified range, have good workability of roll mixing and excellent rebound characteristics as compared with the golf ball of Comparative Examples 1 to 3.

On the other hand, the golf ball of Comparative Example 1 has poor workability of roll mixing, because the amount of (a) polybutadiene synthesized using nickel-containing catalyst is larger and that of (b) polybutadiene synthesized using lanthanide-containing catalyst is smaller. In the golf balls of Comparative Examples 2 and 3, the rebound characteristics of the solid center and the golf ball are degraded, because the amount of (a) polybutadiene synthesized using nickel-containing catalyst is smaller and that of (b) polybutadiene synthesized using lanthanide-containing catalyst is larger.

What is claimed is:

1. A thread wound golf ball comprising a solid center, a thread rubber layer formed on the solid center, and at least one layer of a cover covering the thread rubber layer, wherein the solid center comprises at least one rubber layer, the rubber layer is formed from a rubber composition comprising a polybutadiene mixture, a metal salt of an unsaturated carboxylic acid, an organic peroxide and an inorganic filler, and the polybutadiene mixture consists of (a) a polybutadiene containing a cis-1,4 bond of not less than 80% and having a Mooney viscosity of 55 to 60 $ML_{1+4}$(100° C.), synthesized using a nickel-containing catalyst, and (b) a polybutadiene containing a cis-1,4 bond of not less than 40% and having a Mooney viscosity of 20 to 90 $ML_{1+4}$(100° C.), synthesized using lanthanide-containing catalyst, a weight ratio (a)/(b) being 30/70 to 90/10.

2. The thread wound golf ball according to claim 1, wherein the polybutadiene synthesized using nickel-containing catalyst has a ratio (Mw/Mn) of weight average molecular weight (Mw) to number average molecular weight (Mn) of 4.0 to 8.0.

3. The thread wound golf ball according to claim 1, wherein the solid center has a deformation amount of 1.5 to 6.0 mm, when applying from an initial load of 10 kgf to a final load of 130 kgf.

4. The thread wound golf ball according to claim 1, wherein the cover is formed from thermoplastic resin essentially comprising ionomer resin.

5. A thread wound golf ball comprising a solid center, a thread rubber layer formed on the solid center, and at least one layer of a cover covering the thread rubber layer, wherein the solid center comprises at least one rubber layer, the rubber layer is formed from a rubber composition comprising a polybutadiene mixture, a metal salt of an unsaturated carboxylic acid, an organic peroxide and an inorganic filler, and the polybutadiene mixture comprises (a) a polybutadiene containing a cis-1,4 bond of not less than 80% and having a Mooney viscosity of 55 to 60 $ML_{1+4}$(100° C.), synthesized using a nickel-containing catalyst, and (b) a polybutadiene containing a cis-1,4 bond of not less than 40% and having a Mooney viscosity of 20 to 90 $ML_{1+4}$(100° C.), synthesized using lanthanide-containing catalyst, a weight ratio (a)/(b) being 30/70 to 90/10.

* * * * *